US007438527B2

(12) United States Patent
Albert et al.

(10) Patent No.: US 7,438,527 B2
(45) Date of Patent: Oct. 21, 2008

(54) AIRFOIL TRAILING EDGE COOLING

(75) Inventors: Jason E. Albert, West Hartford, CT (US); Frank J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 554 days.

(21) Appl. No.: 11/112,149

(22) Filed: Apr. 22, 2005

(65) Prior Publication Data

US 2006/0239819 A1 Oct. 26, 2006

(51) Int. Cl.
*F01D 5/08* (2006.01)

(52) U.S. Cl. ..... 416/97 R; 416/90 R

(58) Field of Classification Search ..... 416/96 R, 416/90 R, 97 A
See application file for complete search history.

(56) References Cited

U.S. PATENT DOCUMENTS 4,180,373 A * 12/1979 Moore et al. ..... 416/97 R
4,601,638 A 7/1986 Hill et al.
6,974,308 B2 * 12/2005 Halfmann et al. ..... 416/97 R
2005/0053459 A1 * 3/2005 Cunha et al. ..... 415/115

* cited by examiner

*Primary Examiner*—Edward Look
*Assistant Examiner*—Dwayne J White
(74) *Attorney, Agent, or Firm*—Marjama Muldoon Blasiak & Sullivan LLP

(57) ABSTRACT

A turbine airfoil includes a span wise extending cavity formed from a ceramic mold and a slot extending from the cooling air cavity to a trailing edge being formed by a refractory metal core. The refractory metal core facilitates the reduction in the size of the slot and also in the reduction in the size of pedestals which pass transversely through the slot to interconnect the pressure side to the suction side of the airfoil. The blade has a cutback feature to expose a back surface on the inner side of the suction side wall with dimples being formed on the back surface so as to enhance heat transfer characteristics thereof. Provision is made for fabricating the dimples by way of a photo etching process.

15 Claims, 3 Drawing Sheets

AIRFOIL TRAILING EDGE COOLING

BACKGROUND OF THE INVENTION

This invention relates generally to cooling of airfoils and, more particularly, to a method and apparatus for cooling the trailing edges of gas turbine airfoils.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. This leaves the mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and treated in one or more stages.

The ceramic cores themselves may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned co-pending U.S. Pat. No. 6,637,500 of Shah et al. discloses general use of a ceramic and refractory metal core combination. There remains room for further improvement in such cores and their manufacturing techniques.

The currently used ceramic cores limit casting designs because of their fragility and because cores with thickness dimensions of less than about 0.012-0.015 inches cannot currently be produced with acceptable casting yields.

The trailing edge cut-back geometry is one of the most utilized cooling configurations in airfoil design. This preferred application stems from two practical standpoints. First, the aerodynamic losses associated with such a blade attain the lowest values due to a thinner trailing edge. Second, airfoil high pressure side heat load to the part is reduced by using film cooling at the trailing edge pressure side.

Smaller trailing edge thickness leads to a lower pressure difference between the pressure and the suction sides of the airfoil. Trailing edge configurations without cut-back, known as centerline cooling tailing edges, with a pressure-to-suction side pressure ratio of about 1.35, results in trailing edge thickness in the order of 0.050 in. For these centerline discharge designs, the total pressure loss at 50 percent radial span could be as high as 3.75 percent. This relatively high pressure loss leads to undesirable high aerodynamic losses. A practical way to reduce these losses, is to use a pressure side ejection trialing edge configuration with a cut-back length. In such a configuration, the trailing edge can attain a thickness as low as 0.030 in. to reduce the aerodynamic losses. Typical of such a cut-back design is that shown in U.S. Pat. No. 4,601,638, assigned to the assignee of the present invention and incorporated herein by reference.

In this context, there are several internal cooling design features that control the heat transfer at the trailing edge. These can be summarized as follows: (1) size of the cooling passage; (2) internal cooling features inside the cooling passage; (3) trailing edge thickness distributions; (4) pressure side trailing edge lip thickness; (5) pressure side land roughness, and (6) slot film cooling coverage. It should be noted that only elements (1) and (2) can be used effectively for centerline discharge tailing edge designs; whereas all elements (1) through (6) can be used for the pressure side ejection design with a cut-back trailing edge. In the pressure side ejection designs, the thermal-mechanical fatigue and creep life will also improve with improved metal temperature distributions for the entire trailing edge region.

In general, the external thermal load on the airfoil pressure side is about two times that of the suction side, and therefore, there is a greater potential for pressure side fatigue to occur on the airfoil pressure side. Under cyclic conditions, crack nucleation may also occur sooner on the pressure side.

Since the airfoil trailing edge responds faster than the rest of the airfoil due to its lower thermal mass; these areas are particularly prone to fatigue failure. Crack nucleation leads to linkage with thermal-mechanical fatigue cracking, originating and propagating from the trailing edge. As cracks propagate, load shakedown will occur throughout the blade as the load is redistributed to other portions of the trailing edge. This is particularly true for rotating blades as the centrifugal load remains constant. Load shakedown leads to overload conditions, or conditions where the stresses in the blade may be above yield stress of the material as the load bearing blade area has decreased due to cracking. The material will start deforming plastically even at colder parts of the airfoil. This is an irreversible effect leading in all likelihood to blade liberation and failure. Thus, selection of the trailing edge pressure side ejection design for cooling a blade trailing edge region becomes crucial.

At the trailing edge regions, internal impingement configurations have been used in the gas turbine airfoil design. In general, cooling air is allowed to pass through rib cross-over openings leading to jet impingement onto subsequent ribs and surrounding walls. The flow acceleration is high through these cross-over impingement openings. The coolant flow Mach number profile follows that of the coolant static pressure profile in that it assumes an almost step-wise profile at these openings. The step-wise profiles are undesirable as they lead to relatively high peaks in internal heat transfer coefficients at the walls of the blade. In other words, there are regions in the airfoil trailing edge wall, which attain areas of relatively lower metal temperatures with high internal heat transfer coefficients. Meanwhile, other areas with lower internal convective heat transfer coefficients lead to relatively higher metal temperatures. These metal temperature differences lead to high thermal strains, which in conjunction with transient thermal stresses in the airfoil during take-off, in turn, lead to undesirable thermal-mechanical fatigue problems in the airfoil trailing edge.

SUMMARY OF THE INVENTION

Briefly, in accordance with one aspect of the invention, a trailing edge cooling design is provided for improving the internal profiles for Mach number, static pressure drop, and internal heat transfer coefficient distribution along the airfoil trailing edge.

In accordance with another aspect of the invention, a plurality of relatively small pedestals are formed, by the use of refractory metal cores, in an internal channel between the walls of the airfoil near the trailing edge so as to thereby provide improved cooling characteristics and avoid step wise profiles and their associated high thermal strains and mechanical fatigue problems in the airfoil trailing edge.

By yet another aspect of the invention, the internal surface of the suction side wall aft of the pressure side lip is made rough to enhance the coolant heat transfer coefficient at that location. In one form, a plurality of dimples are formed on that surface for that purpose.

In the drawings as hereinafter described, a preferred embodiment is depicted; however, various other modifications and alternate constructions can be made thereto without departing from the spirit and scope of the invention.

DESCRIPTION OF THE PREFERRED EMBODIMENT

The use of refractory metal core (RMC) casting techniques offer certain advantages over the prior art approach of casting with ceramic molds. Such a process is described in U.S. Patent Publication US2003/0075300 A1 assigned to the assignee of the present invention and incorporated herein by reference.

One of the advantages of this RMC casting technology as recognized by the applicants, is that individual elements can be made much smaller than with conventional casting technologies and the features can be customized to almost any shape. Accordingly, the applicants have employed this technology to produce a refined and improved trailing edge cooling channel.

Figure 1:
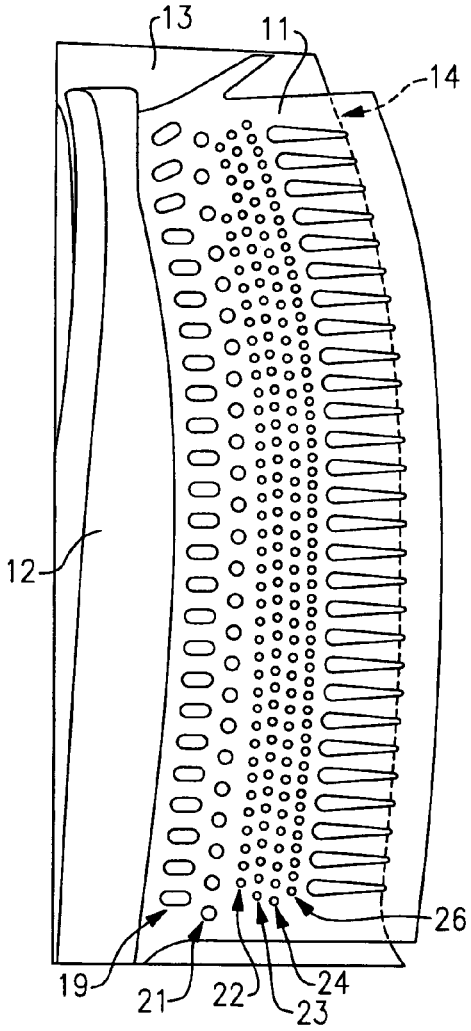
FIG. 1 is a cutaway view from a pressure side of a high pressure turbine blade core illustrating a pedestal core at the trailing edge in accordance with one aspect of the invention.
Figure 2:
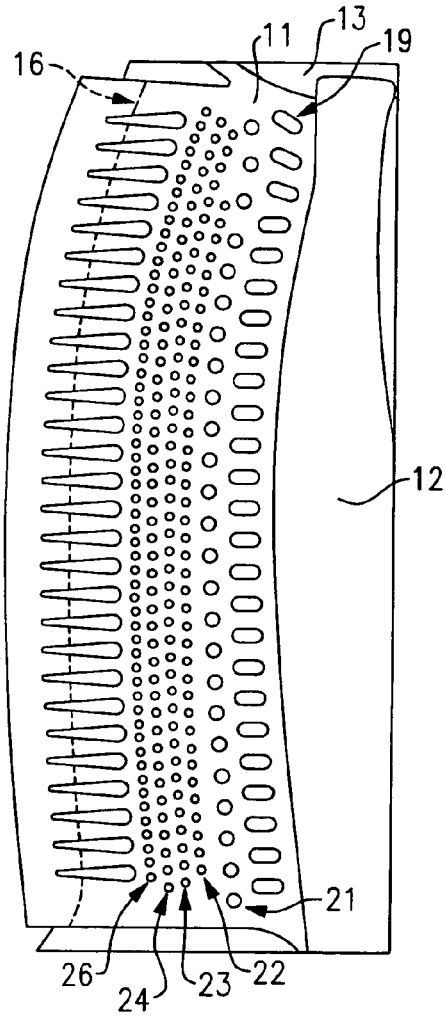
FIG. 2 is a cutaway view from a suction side of a high pressure turbine blade core illustrating a pedestal core at the trailing edge in accordance with one aspect of the invention.

Referring to FIGS. 1 and 2, there is shown a turbine blade core constructed with the use of a refractory metal (i.e. a refractory metal core or RMC) 11. The RMC core 11 is shown in combination with a ceramic core 12 defining the radial supply cavity, with both of these elements representing negative features in the final cast part (i.e. they will be internal passages for the flow of cooling air, first radially within the blade and then through a plurality of pedestals as will be described, and finally out the trailing edge of the blade).

Also shown in FIGS. 1 and 2 is the final cast part 13 with its plurality of pedestals and flow directing islands as will be described. A view of the combination from the pressure side is shown in FIG. 1 and a view from the suction side is shown in FIG. 2. In this regard, it should be recognized that the trailing edge 14 on the suction side extends farther back than the trailing edge 16 on the pressure side, with the difference being what is commonly referred as cut-back, a feature that is commonly used in the effective cooling of the trailing edge of turbine blades.

The first row of pedestals as shown at 19 in FIGS. 1-4, which are formed by the first row of openings in the RMC core 11, are relatively large (i.e. on the order of 0.025"× 0.055") in order to form a better structural the between the pressure side and suction side walls of the airfoil. As will be seen in FIGS. 1, 2 and 3, the first row of pedestals 19 are generally elliptical in cross section, and with those pedestals near the tip having their major axes being progressively angled away from a longitudinal orientation and toward the tip. The second row of pedestals (i.e. those formed by the second row of holes in the RMC) as shown at 21 are also relatively large and act as transitional pedestals.

Moving downstream from the first two rows of pedestals, there is an array of relatively small, closely packed pedestals in several rows as indicated at 22, 23, 24 and 26. These pedestals are formed by corresponding rows of openings of the RMC core 11. The use of smaller, higher density pedestals is intended to provide for a smooth transition and pressure drop, resulting in a more continuous heat transfer coefficient distribution. In this regard, a comparison with the size and density of pedestals made with conventional core casting is appropriate. With conventional core casting, the diameter of a cylindrical pedestal is limited to diameters greater than 0.020 inches, and the gap between pedestals is limited to dimensions greater than 0.020 inches. In practice, because of low yield rates, both these dimensions would be substantially greater because of the fragility of the cores. In contrast, with the use of RMC castings, the diameter of cylindrical pedestals can be substantially below 0.020 inches and can be as small as 0.009 inches. Similarly, with RMC castings, the gap between pedestals can be reduced substantially below 0.020 inches, and can be reduced down to about 0.010 inches. With these reduced diameters and spacings, it is possible to obtain substantially improved uniform profiles of pressure, Mach number and heat transfer coefficients.

Although the pedestals are shown as being circular in cross section they can just as well be oval, racetrack, square, rectangular, diamond, clover leaf or similar shapes as desired.

Figure 3:
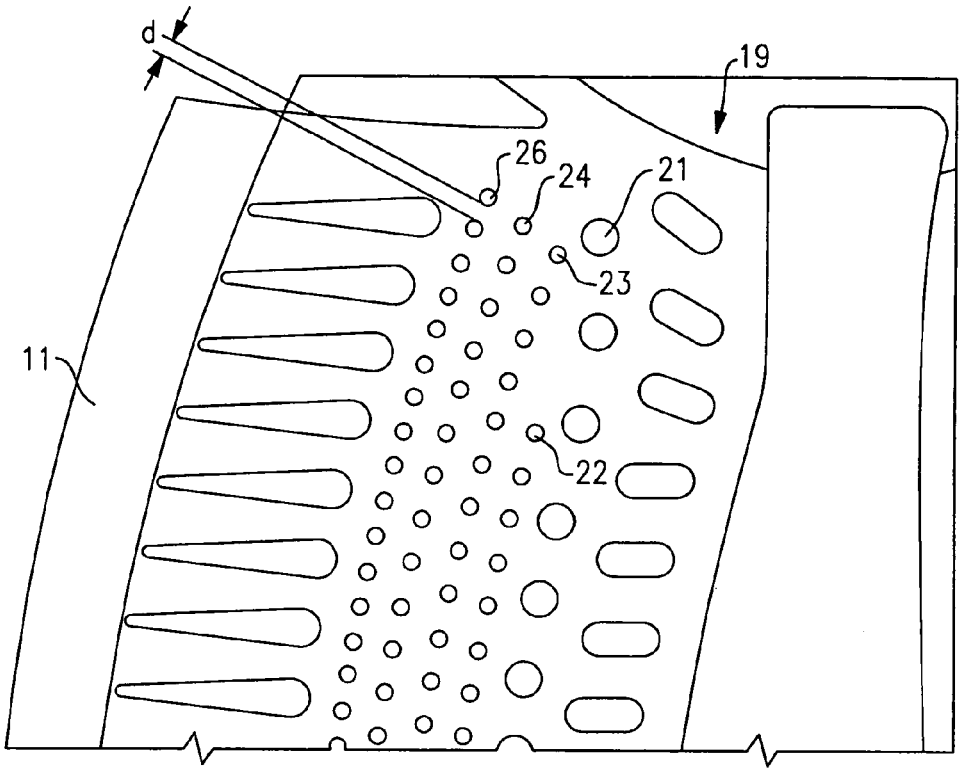
FIG. 3 is a schematic illustration of a portion of a ceramic core as enlarged to show the pedestals in greater detail.

In respect to the spacing between adjacent pedestals, it may be recognized that the closest spacing between pedestals is within a single row, such as shown in FIG. 3 by the dimension d between adjacent pedestals in row 26. Although the distance between adjacent rows, and the distance between adjacent pedestals in adjacent rows, are shown as being greater than the distance d, it should be understood that these distances could also be decreased to approach a minimum distance of 0.010 inches.

Figure 4:
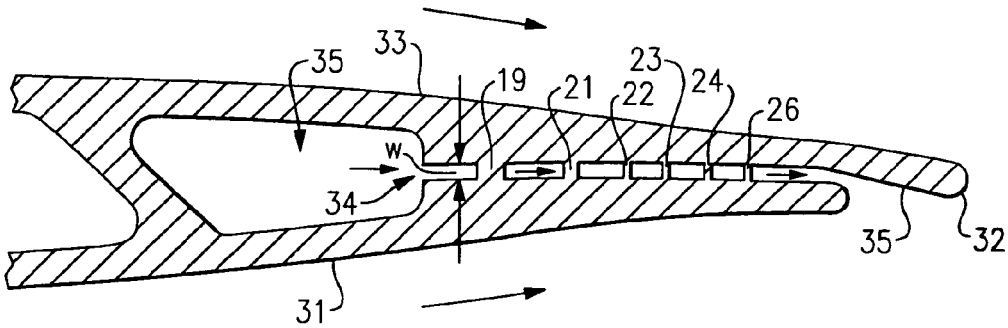
FIG. 4 is a partial sectional view of a turbine blade with a cooling air passageway and pedestal in accordance with one aspect of the invention.

In order to reduce aerodynamic losses, which degrade turbine efficiency, it is desirable to make the trailing edge of a turbine airfoil as thin as possible. One successful approach for doing is shown in FIG. 4 wherein the pressure side wall 31 is discontinued short of the trailing edge 32, and film cooling from the slot 34 is relied on to keep the suction side wall 33 below a desired temperature. Here, the outside arrows passing over the pressure side wall 31 and the suction side wall 33 represent hot gas path air and the arrows passing through the slot 34 represent cooling air from the internal cooling circuits of the airfoil.

As will be understood, the FIG. 4 embodiment is a cross sectional view of the rear portion of a turbine blade that has been fabricated by the use of both a ceramic core and an RMC core. That is, the supply cavity 35 is formed by a conventional ceramic core, whereas the channel or slot 34 is formed with the refractory metal core. In this regard, it should be understood that, although the pedestals rows 19, 21, 22, 23, 24 and 26 are all shown in this view, for purposes of facilitating the description, because of their staggered placements, not all of the pedestals would be sectioned through in this particular plane.

In addition to the small diameter of the pedestals as discussed hereinabove, the use of RMCs also facilitates the formation of the channel or slot 34 of significantly reduced dimensions. This, of course, results from the use of substantially thinner RMC than can be accomplished with the conventional core casting. That is, by comparison, a typical trailing edge pedestal array using conventional casting technology would have a considerably thicker core with larger features in order to allow the ceramic slurry to fully fill the core die when creating the core, in order to keep the ceramic core from breaking during manufacturing processes. Using conventional technology, the final cast part would have a wider flow channel through the trailing edge and larger features in the flow channel. This would result in high trailing edge cooling airflow with less convective cooling effectiveness. To be more specific, the slot width W (i.e. the thickness of a casting core) using conventional core casting, would necessarily be greater than 0.014 inches after tapering to the thinnest point, whereas with RMC casting use, the width W of the channel 34 can be in the range of 0.010-0.014 inches over its entire length. Such a reduction in slot size can significantly enhance the effectiveness of internal cooling airflow in the cooling of the trailing edge of an airfoil.

The description of the pedestals and slots as described above is related to the blade internal passageways for conducting the flow of cooling air toward the trailing edge of the blade. Another feature of the present invention will now be discussed in respect to an external area closer to the trailing edge of the blade.

As will be understood, the only cooling mechanism for the extreme trailing edge 32 of the airfoil is the convective heat transfer between the cooling air and metal on the suction side wall 35 near the trailing edge 32. This cooling can be made more effective by 1) increasing the trailing edge flow, which is typically not desirable, 2) decreasing the temperature of the trailing edge flow, which is dependent of the internal cooling circuit upstream of the suction side wall 35, or 3) increasing the convective heat transfer coefficient at the suction side wall 35 near the trailing edge 32. It is this third option which is accomplished by creating roughness in the form of positive dimples or similar features in the cut-back portion 35 of the suction side wall 33. Based on experimental studies, it is estimated that this roughness can increase the convective heat transfer by a factor of about 1.5.

Shown in FIGS. 5*a*, 5*b*, 5*c* and 6, the steps are shown for the manufacturing methodology used to create a trailing edge slot roughness using refractory metal cores. Although the discussion is specific to positive, hemispherical dimples, different shapes of these positive features can be made using the same methodology in order to achieve the same cooling purpose. For example, long strips, star patterns, etc. may be used.

Figure 5A:
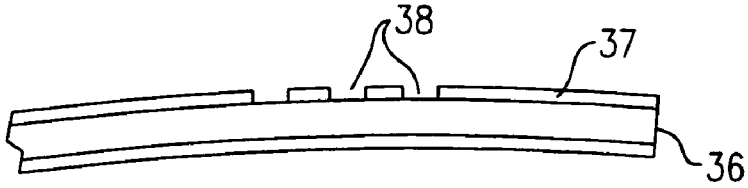
FIGS. 5*a*-5*c* shows a refractory metal core that is processed to obtain dimples on the trailing edge of a blade in accordance with the present invention.

As shown in FIG. 5*a*, a refractory metal core 36 is covered with a mask 37, with portions 38 removed using photo-etching, a process capable of obtaining accurate small scale features. The photo-etched openings 38 are preferable circular in order to form a dimple which is in the form of a portion of a sphere. The mask RMC is then submerged in a chemical solution that etches away the portions of the RMC not masked.

Figure 5B:
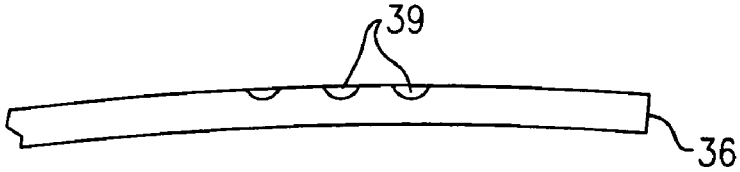

As shown in FIG. 5*b*, these etched regions then result in rounded depressions 39 in the RMC 36 with the depth being dependent on the amount of time the RMC remains in the chemical etching solution. The RMC is then cleaned and used as a core for a cast airfoil.

Figure 5C:
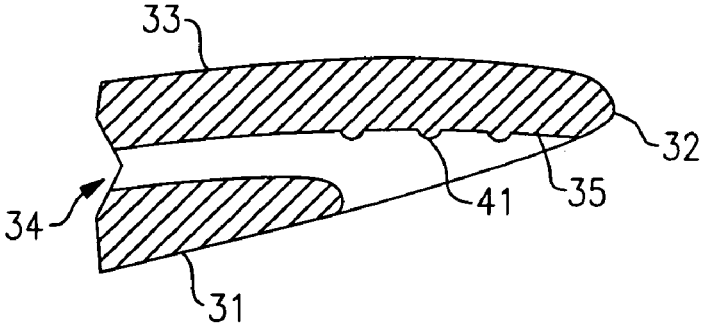
Figure 6:
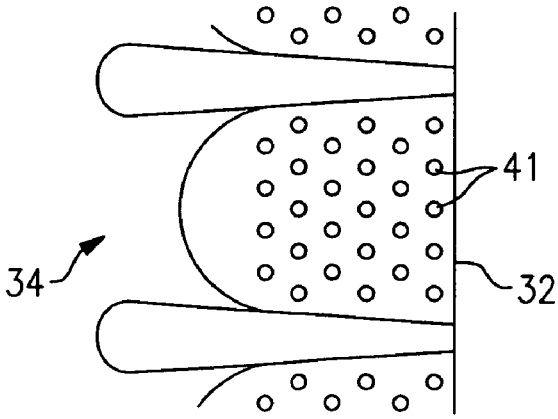
FIG. 6 is a partial plan view of a blade trailing edge with the dimples so formed.

The result is shown in FIG. 5*c* wherein dimples having an outer surface in the shape of a portion of a sphere are formed on the RMC cut-back surface 35 as shown in FIGS. 5*c* and 6. It will be seen and understood, that the size of the dimples 41 are quite small as compared with the slot 34. For example, a design that has been found to perform satisfactorily is one wherein the dimples are a portion of a sphere in form with a foot print diameter in the range of 0.005"-0.020" and a height in the range of 0.002"-0.008" with a spacing between adjacent dimples being in the range of 0.010"-0.040".

As an example of the potential benefits of using dimples on a trailing edge slot roughness, consider the trailing edge cooling of a typical commercial high pressure turbine first blade. If the convective heat transfer at the suction side wall of the slot increases by a factor of 1.5 due to the additional positive dimples, the metal temperatures at the extreme trailing edge would be reduced by 60° F., given the same amount of cooling air flow. This is a very significant potential for reducing cooling air flow for increasing part life.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. An airfoil having a tip, a pressure side wall having a span-wise extending downstream edge and a suction side wall having a downstream trailing edge, said downstream edge being spaced from said trailing edge to expose a back surface of said suction side wall, comprising;

a span-wise cooling air cavity defined between said pressure and suction side walls;

a trailing edge region disposed downstream of said cavity;

a span-wise extending slot fluidly interconnecting said cooling air cavity to said trailing edge region;

wherein said slot includes a plurality of pedestals extending between said suction side and pressure side walls and through said slot, said pedestals being disposed in span wise extending rows with the most upstream row having pedestals of greater cross sectional dimension and those more downstream rows having pedestals of lesser cross sectional dimension wherein said most upstream row of pedestals are generally elliptical in cross section, and with those pedestals near said tip having their major axes being progressively angled away from a longitudinal orientation and toward said tip.

2. An airfoil as set forth in claim 1 wherein the more downstream pedestal rows include a plurality of rows of pedestals having cross sectional dimensions which are substantially equal.

3. An airfoil as set forth in claim 2 wherein said pedestals have cross sectional dimensions which are less then 0.020 inches.

4. An airfoil as set forth in claim 3 wherein said pedestals have cross section dimensions which are in the range of 0.009-0.020 inches.

5. An airfoil as set forth in claim 1 wherein the gap between adjacent pedestals in each row is no greater than 0.021 inches.

6. An airfoil as set forth in claim 5 wherein said gap is in the range of 0.010-0.021 inches.

7. An airfoil as set forth in claim 1 wherein said slot has a width which is less then 0.014 inches along its entire length.

8. An airfoil as set forth in claim 7 wherein said slot has a width in the range of 0.010-0.014 inches along its entire length.

9. An airfoil having the radially extending cooling air cavity defined on two sides by a pressure side wall and a suction side wall, a trailing edge region disposed downstream of said cavity and having a longitudinally extending cooling air slot, said suction side wall having a downstream trailing edge and said pressure side wall having a span-wise extending downstream edge spaced from said downstream trailing edge to expose a back surface of said suction side wall;

wherein said back surface has formed thereon a plurality of dimples that extend into the flow of cooling air passing through said slot wherein said dimples are hemispherical in form and have a foot print diameter in the range of 0.005"-0.020".

10. An airfoil having the radially extending cooling air cavity defined on two sides by a pressure side wall and a suction side wall, a trailing edge region disposed downstream of said cavity and having a longitudinally extending cooling air slot, said suction side wall having a downstream trailing edge and said pressure side wall having a span-wise extending downstream edge spaced from said downstream trailing edge to expose a back surface of said suction side wall;

wherein said back surface has formed thereon a plurality of dimples that extend into the flow of cooling air passing through said slot wherein said dimples projections have a height in the range of 0.002"-0.008".

11. An airfoil having the radially extending cooling air cavity defined on two sides by a pressure side wall and a suction side wall, a trailing edge region disposed downstream of said cavity and having a longitudinally extending cooling air slot, said suction side wall having a downstream trailing edge and said pressure side wall having a span-wise extending downstream edge spaced from said downstream trailing edge to expose a back surface of said suction side wall;

wherein said back surface has formed thereon a plurality of dimples that extend into the flow of cooling air passing through said slot wherein the distance between adjacent dimples is in the range of 0.010"-0.040".

12. An airfoil having a tip, a pressure side wall, a suction side wall, a leading edge and a trailing edge, with the trailing edge being cut-back on the pressure side to expose an open land on a rear surface of said suction side wall and comprising:

a cooling air flow passage extending generally in a direction from said leading edge to said trailing edge to conduct the flow of cooling air first from an internal cavity between said pressure side wall and said suction side wall and to said open land and then to said trailing edge comprising:

a plurality of pedestals formed between said low and high pressure sides and passing through said cooling air flow passage, said pedestals being aligned in adjacent rows extending in a direction generally normal to said cooling airflow, with at least one upstream row having pedestals that are of greater cross sectional areas than those of the downstream rows wherein said most upstream row of pedestals are generally elliptical in cross section, and with those pedestals near said tip having their major axes being progressively angled away from a longitudinal orientation and toward said tip.

13. An airfoil as set forth in claim 12 wherein the more downstream pedestal rows include a plurality of rows of pedestals having cross sectional dimensions which are substantially equal.

14. An airfoil as set forth in claim 12 wherein said pedestals have cross sectional dimensions which are less then 0.020 inches.

15. An airfoil as set forth in claim 12 wherein said slot has a width which is less then 0.014 inches.

* * * * *